United States Patent [19]

Post

[11] Patent Number: 4,708,009

[45] Date of Patent: Nov. 24, 1987

[54] BENDING DEVICE FOR THE PRODUCTION OF FORMED PARTS CONSISTING OF WIRE OR STRIP SECTIONS

[75] Inventor: Friedhelm Post, Wallbach, Fed. Rep. of Germany

[73] Assignee: Alpha Maschinenbau AG., Zurich, Switzerland

[21] Appl. No.: 867,958

[22] Filed: May 29, 1986

[30] Foreign Application Priority Data

Jul. 3, 1985 [DE] Fed. Rep. of Germany ..... 3523828

[51] Int. Cl.[4] ..... B21D 37/12

[52] U.S. Cl. ..... 72/442; 72/452; 72/472; 72/404; 72/446; 72/399; 72/381; 83/499

[58] Field of Search ..... 72/452, 356, 472, 404, 72/446, 442, 399, 401, 402, 381, 384, 212, 213, 219, 454, 390, 447, 448; 493/365, 370, 618, 619; 29/33 F, 33 S, 34 D; 83/499, 504

[56] References Cited

U.S. PATENT DOCUMENTS

| | | | |
|---|---|---|---|
| 3,540,340 | 11/1970 | Koskela | 83/499 |
| 3,881,343 | 5/1975 | Ducate | 72/446 |
| 3,945,239 | 3/1976 | Russell | 72/402 |
| 4,077,291 | 3/1978 | Obenshain | 83/499 |
| 4,269,097 | 5/1981 | Linn | 83/499 |
| 4,580,329 | 4/1986 | Bihler et al. | 72/442 |
| 4,607,517 | 8/1986 | Finzer et al. | 72/446 |

*Primary Examiner*—Robert L. Spruill
*Assistant Examiner*—David B. Jones
*Attorney, Agent, or Firm*—James E. Nilles

[57] ABSTRACT

The apparatus of this invention, for bending wire and metal strip, comprises a stationary working plate, a drive shaft rotatable in bearings spaced along its length and fixed relative to the working plate, and a tool guide unit confined to adjustment relative to the working plate in directions parallel to the drive shaft and carrying a tool slide that it guides for reciprocation transverse to the drive shaft. A cam on the drive shaft by which the tool slide is reciprocated is fixed to an axial sleeve portion concentric to the drive shaft and axially slidable along it, which sleeve portion is rotatably received in a cam bearing that is secured in the tool guide unit. The cam bearing thus radially supports the cam and the drive shaft so that the drive shaft can be relatively slender and light.

7 Claims, 3 Drawing Figures

BENDING DEVICE FOR THE PRODUCTION OF FORMED PARTS CONSISTING OF WIRE OR STRIP SECTIONS

DESCRIPTION

The present invention refers to a device for bending elongated metal such as wire or metal strip, of the type comprising a relatively stationary working plate or bed, a drive shaft confined to rotation in shaft bearings which are fixed relative to the working plate and which are spaced apart along the length of the drive shaft, a tool slide to which is attached a tool for performing a bending operation, a tool guide unit which is supported on the working plate and is adjustable relative to it in directions parallel to the drive shaft and which guidingly confines the tool slide to reciprocation in opposite working directions that are transverse to the length of the drive shaft, and a cam on the drive shaft, constrained to rotate with it, that has a connection with the tool slide whereby the tool slide is reciprocated by rotation of the drive shaft.

In the case of known bending devices of this type, the guide units only fulfil the task of positioning the tool slides and transmitting to said tool slides the movements and forces derived from the drive shaft. The reaction forces resulting from the bending operations are retransmitted to the drive shaft and from said drive shaft they are transmitted to the support bearings which are arranged adjacent the working plate within the frame of the bending device. This requires a great structural expenditure for accommodating the support bearings and necessitates a thick drive shaft, since the support bearings are not always positioned directly at the location at which the reaction forces act on the drive shaft. The bending device as a whole has a big and heavy structural design. In view of the fact that, futhermore, the guide units are held, in most cases at four points, by means of sliding members in T-grooves in the working plate, a displacement of the guide units entails the disadvantage that the tool slides and the tools must be readjusted, since the displaced guide unit is, in many cases, displaced in the T-grooves more than 1 mm transversely to the longitudinal direction of the T-grooves.

The present invention is based on the task of providing a bending device of the type mentioned at the beginning, which is characterized by a simplified and compact structural design and by an optimum transmission of reaction forces.

The present invention solves the posed task by the provision of at least one cam bearing secured in the tool guide unit and through which the drive shaft extends, and a sleeve portion to which the cam is secured and which extends axially therefrom in concentric surrounding relation to the drive shaft, said sleeve portion being received in the cam bearing or cam bearings for radial support of the cam in its rotation with the drive shaft.

Space for accommodating the drive shaft and the support bearings is no longer required outside of the working plate. The bending device has a more compact and less heavy structural design. The reaction forces resulting from the bending operations are taken up directly in the guide unit and are transmitted to the working plate, and the support bearings are—independently of a displacement of the guide unit—always positioned at the location at which the reaction forces occur. This results in the important advantage of a comparatively thin and light drive shaft, which is easy to mount and which permits also the use of support bearings having smaller dimensions.

An additional particularly important embodiment is one wherein the tool guide unit is support for adjusting displacement relative to the working plate on a prismatic strip of dovetail cross-section which is secured to the working plate and which has its length parallel to the drive shaft, the tool guide unit having a groove of mating dovetail cross-section wherein the prismatic strip is slidably received. By means of this prismatic strip, which can be secured in position on the working plate in a very stable manner, high reaction forces can perfectly be transmitted into the working plate. The working plate no longer has to have provided therein any T-grooves, and this has the effect that the production of said working plate is simplified and that its form strength is increased. The most important advantage of this support principle is, however, that the guide units can be displaced very precisely and smoothly and that, in displaced positions, they are, with an accuracy of 1/10 mm, located at the same distance from the bending station so that the complicated readjustment of the tools and/or of the tool slides after a bending device resetting operation can be dispensed with. The prismatic strip used for supporting the guide units is also advantageous irrespectively of whether the guide unit has provided therein support bearings for the drive shaft or whether a drive shaft is responsible for the movements of the tool slides. A support which is particularly capable of bearing loads is obtained by securement of the primmatic strip to the guide plate by means of screws or pins. Moreover, in the case of this fastening mode the prismatic strips provided can easily be displaced.

Resetting of the bending device with a displacement of the guide units can be achieved in a particularly simple manner by the provision of a clamping device which cooperates with the prismatic strip and the groove in the tool guide unit to secure the tool guide unit to that strip, the clamping device ensuring also that the guide means position once determined on the prismatic strip is maintained.

In this connection, the provision of a hydraulic or pneumatic actuator for the clamping device makes it possible to actuate the clamping devices in a simple and, if necessary, remotecontrolled manner.

An additional important aspect is the provision of a spindle drive adjusting device comprising a threaded shaft for adjustingly shifting each of a plurality of tool guide units that are spaced along a prismatic strip and are associated with one and the same drive shaft. In the adjustment device, the guide units can arbitrarily be displaced on the working plate and along the prismatic strip as soon as the bending devices must be adapted to new programs. In accordance with a simple embodiment, a threaded spindle displaces the guide units, said guide units having provided therein the threaded nuts which can selectively be prevented from carrying out a rotation so that each guide unit is adapted to be displaced separately and individually. If necessary, the bending device resetting can thus be carried out in a programand remote-controlled manner, and this has the effect that time can be saved and that complicated adjustment operations can be dispensed with.

An additional feature simplifying the resetting operations is the provision of a sleeve portion to which the cam is secured that projects in both axial directions from the cam, is axially slidable on the drive shaft but non-rotatable relative to it, and is received in two cam bearings fixed in the tool guide unit, one at each axial side of the cam, whereby the cam and the sleeve portion are confined to rotation with the drive shaft.

By arranging the cam, the sleeve portion and the cam bearings as a replaceable structural unit, resetting of the bending device is carried out such that the respective complete structural units are exchanged and replaced by new structural units which are in stock and which have differently designed cam disks. It will be expedient to design the sliding sleeve as a sleeve with flexural rigidity so as to keep the bending forces off the drive shaft so that said drive shaft can be constructed with the smallest possible cross-section.

Finally, also by making the tool guide unit in two parts which are detachably secured to one another and which can be separated on a plane that contains the axis of the drive shaft, the amount of time required for the resetting operation is reduced as far as possible and the resetting operation can be carried out in a simple manner.

In the following, one embodiment of the subject matter of the invention will be explained on the basis of the drawings, in which.

Figure 1:
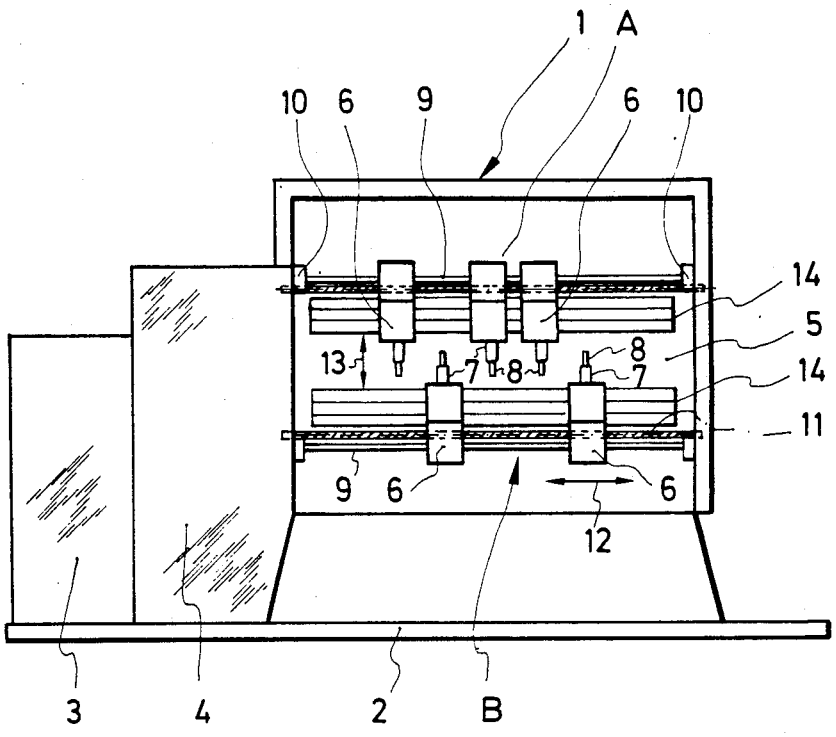
FIG. 1 shows a schematic front view of a bending device.

A bending device 1 according to FIG. 1 is used for bending wire or metal sections, the bending being carried out either at portions having a predetermined length or at a continuous length of material. The bending device 1 is provided with a base 2, said base 2 having arranged thereon device components 3, 4 which are required for feeding and for adjusting the length of material to be bent (not shown) and which are located adjacent a working plate 5. The working plate 5 has attached thereto groups A,B of guide units 6, each of said guide units 6 having provided therein a tool slide 7 which is guided such that it is adapted to be displaced in the direction of a double arrow 13. Each tool slide 7 has attached thereto a bending tool 8 or a counter support which is not shown in great detail. Through each group of guide units 6 a drive shaft 9 extends, which is supported at the edges of the working plate in easily openable bearings 10 and which is connected to a rotary drive means not shown in detail. The drive shaft is a comparatively thin shaft provided with a feather key or feather keys, or designed as a spline shaft or a profile shaft (hexagon).

Furthermore, a threaded spindle 11 extends through each group A,B of guide units 6, said spindle 11 cooperating with spindle nuts 37 (FIG. 3), which are arranged in the guide units and which are used for the purpose of displacing said guide units 6 in the direction of a double arrow 12. Each group A,B of guide units 6 is attached to a prismatic strip 14 which is secured to the working plate 5 such that it extends parallel to the drive shaft 9, said groups of guide units being attached such that the guide units 6 can be displaced in the longitudinal direction of the prismatic strip 14 so that the bending device 1 can be adapted to various bending conditions.

Figure 2:
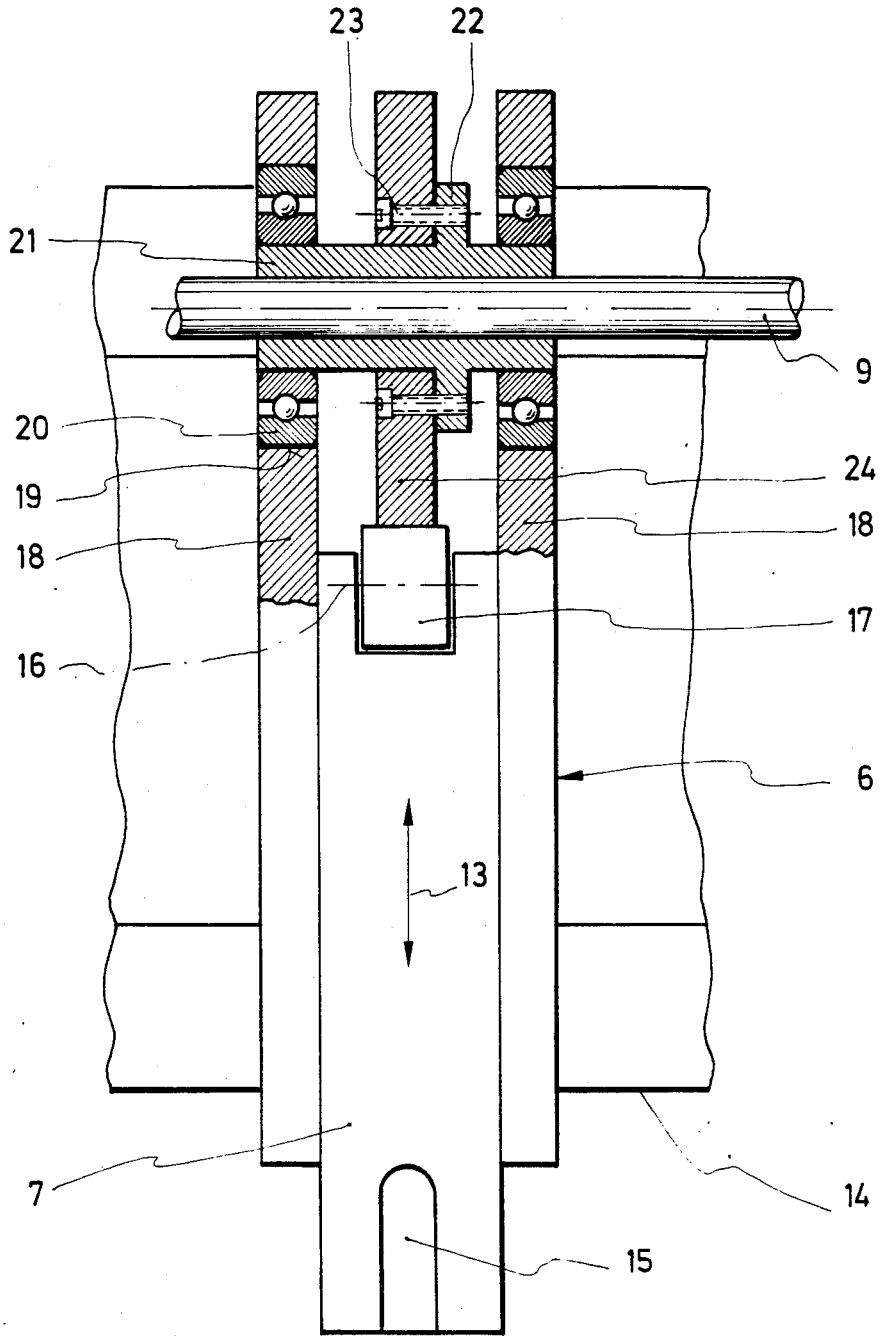
FIG. 2 shows a detail of the bending device of FIG. 1 in an enlarged and partially sectional view.
Figure 3:
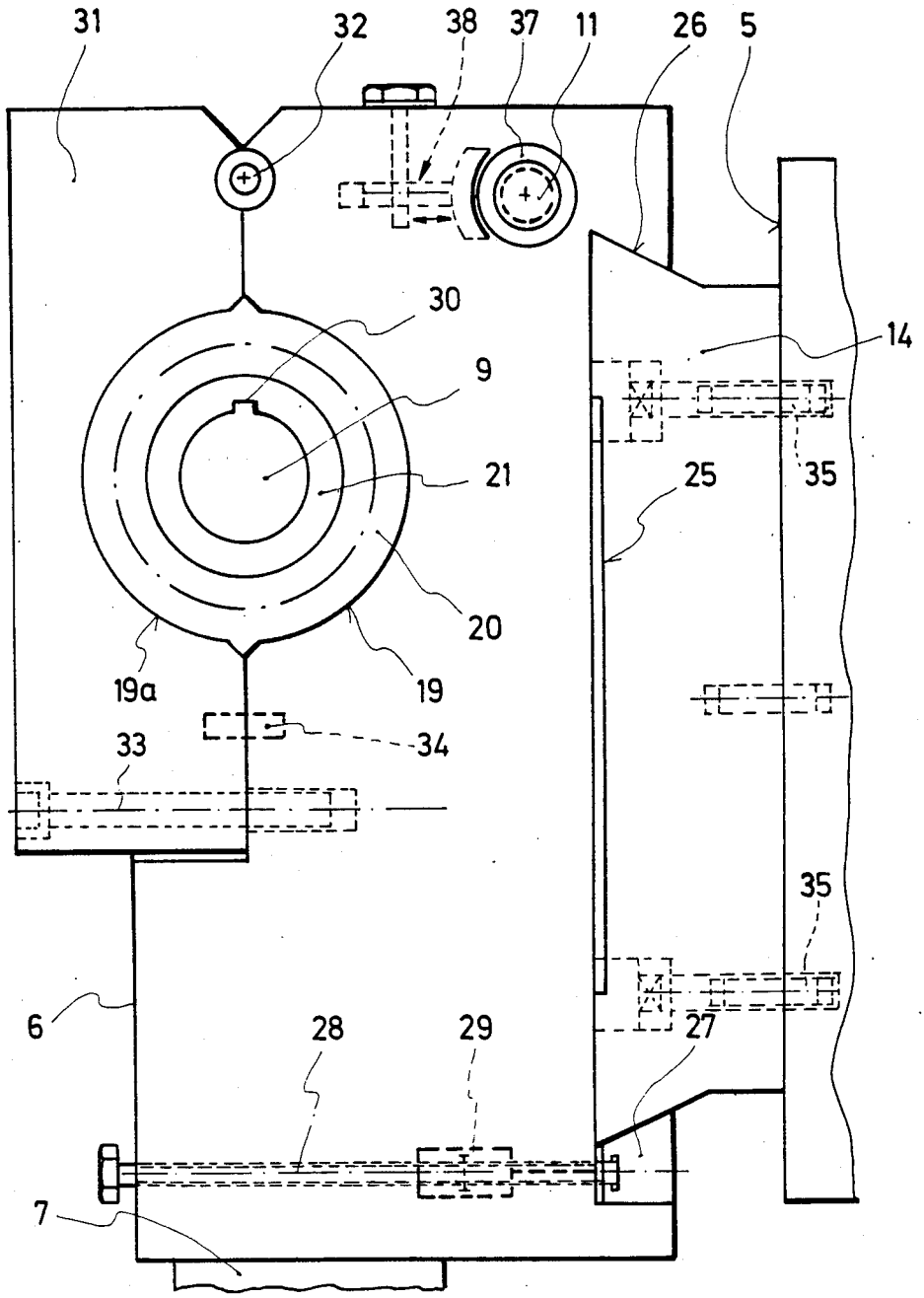
FIG. 3 shows a side view concerning the detail according to FIG. 2.

In FIG. 2 and 3, a guide unit 6 is shown in detail, said guide unit 6 containing the tool slide 7, which, at the lower end thereof, is provided with a fixing recess 15 (FIG. 2) for the tool, which is not shown. In the other end of the tool slide 7, a follow-up member 17 is adapted to be rotated about an axis 16. The guide unit side walls, which are designated by reference numeral 18, define at the end facing away from the tool slide 7 semibowl-shaped reception means 19 for support bearings 20 designed as roller bearings; in the case of the embodiment shown, two bearings of this type are provided in each guide unit 6. The support bearings 20 are attached to—e.g. pressed onto or shrunk onto—a sliding sleeve 21, which is provided with a collar 22 having releasably secured thereto the cam disk 24 by means of fixing elements 23. The cam disk 24 is operatively connected to the follow-up member 17 in such a way that, in the case of a rotation of the drive shaft 9 and of the sliding sleeve 21 keyed thereto, said followup member will move the tool slide 7 in the direction of the double arrow 13. If necessary, restoring springs—not shown—for the tool slide are provided, which hold the follow-up member 17 of said tool slide in contact with the cam disk 24.

In FIG. 3, it can be seen that the upper side of the prismatic strip 14 is provided with a longitudinally extending recessed portion 25 and that the crown of said prismatic strip engages a dovetail groove 26 of the guide unit 6. Blocklike clamping elements 27, one of which can be seen in FIG. 3, serve to secure the guide unit 6 in position at a selected location along the length of the prismatic strip 14. The clamping element 27 is moved between a release position in which the guide unit 6 can be displaced and a clamping position in which said guide unit is fixed, said movement being effected either mechanically by means of a screw spindle 28 or pneumatically or hydraulically via a working cylinder 29. Another possibility would be that an electromagnetic clamping device is used for this purpose.

In FIG. 3, a feather key 30 can be seen, which is provided on the drive shaft 9 and which cooperates with a complementary groove in the sliding sleeve 21. The support bearing 20 is located in the semibowl-shaped reception means 19 of the side wall 18 of the guide unit 6 and is held within said reception means 19 by a counter-reception means **19*a* which has the same shape and which is formed in a cover 31 adapted to be opened by turning on a hinge 32. The cover 31 can be secured in position by screw fastening means 33 and can be centred by means of a centre pin 34. An additional possibility would be to support the cover 31** such that it is fully removable.

The prismatic strip 14 is secured in position on the working plate 5 by means of screws or fixing pins 35. In the case of major bending device resetting operations also the position of the prismatic strip 14 can be changed.

In the case of this embodiment, the threaded spindle 11 for the displacing movement of the guide units extends through the guide unit 6 in the vicinity of the dovetail groove 26 and engages at this location a spindle nut 37, which can be prevented from rotating by means of a fixing device 38. This provides the possibility of displacing, in the case of a rotation of the threaded spindle 11, each guide means on the prismatic strip 14 individually. In accordance with one possible embodiment, the clamping devices 27 and the means 38 are remote-controlled so that the positions of the guide units can be changed in a program-dependent and preset manner. The sliding sleeve 21 defines a structural unit together with the support bearings 20 and the cam disk 24, said structural unit being exchanged as a whole when a different cam disk 24 is required. For this purpose, it is first of all necessary to expose the drive shaft 9 in its bearings 10 and to open then the covers 31 of the group A or B of guide units. It is now possible to remove the drive shaft 9, with the structural units located thereon, from the reception means 19 of all guide units prior to pushing said structural units off the drive shaft and replacing them by other units. Subsequently, the position of the guide units 6 on the prismatic strip 14 is readjusted, if necessary, whereupon the drive shaft 9 provided with the new structural units is reintroduced in such a way that the support bearings 20 are positioned in the reception means 19 and, following this, the covers 31 and the bearings 10 are closed again.

The reaction forces,which occur during the bending process and which the tool slides 7 apply to the cam disk 24, are directly introduced into the support bearings 20 by means of the sliding sleeve 21 and from said support bearings they are transferred to the guide unit 6, which introduces them into the prismatic strip 14 and, consequently, directly into the working plate 5. Hence, the drive shaft 9 can be provided with a non-sturdy and thin structural design, since it only has to transmit the torque by means of which the cam disks 24 are rotated. The bending loads resulting from the reaction forces are primarly taken up by the sliding sleeve 21.

I claim:

1. Apparatus for bending elongated metal such as wire or metal strip, of the type comprising a relatively stationary working plate, a drive shaft confined to rotation in shaft bearings which are spaced apart along the length of the drive shaft and are in fixed relation to said working plate, a tool slide to which a tool is attachable, a tool guide unit for support by said working plate and by which said tool slide is guided for reciprocation in opposite working directions that are transverse to the length of said guide shaft, cooperating means on said working plate and on the tool guide unit for confining the latter to adjusting displacement between said shaft bearings in directions parallel to said drive shaft and for fixing the tool guide unit in any selected position of such displacement, and a cam on said drive shaft, constrained to rotation therewith, that has a connection with said tool slide whereby the tool slide is reciprocated by rotation of said drive shaft, said apparatus being characterized by:

A. said tool guide unit having at least one cam bearing secured therein through which said drive shaft extends; and B. said cam being fixed to a sleeve portion which (1) extends axially therefrom, (2) concentrically surrounds said drive shaft and is axially slidable along it, and (3) is rotatably received in said cam bearing for radial support of the cam in its rotation with the drive shaft.

2. The apparatus of claim 1 wherein said cooperating means comprises:

(1) a prismatic strip of dovetail cross-section which is fixed on said working plate and extends lengthwise parallel to said drive shaft; and (2) a mating dovetail groove in said tool guide unit wherein said prismatic strip is slidably received.

3. The apparatus of claim 1, further characterized in that said cooperating means comprises:

(1) a threaded shaft confined to rotation relative to said working plate and extending parallel to said drive shaft, and (2) internally threaded means on said tool guide unit providing a connection between it and said threaded shaft whereby rotation of the latter effects adjusting displacement of the tool guide unit.

4. The apparatus of claim 3, further characterized by:

(1) said internally threaded means comprising a sleeve member confined to rotation relative to said tool guide unit, and (2) means on said tool guide unit for releasably locking said sleeve member against rotation relative to the tool guide unit so that the tool guide unit can be adjustingly displaced by rotation of the threaded shaft when said sleeve member is locked against rotation and can remain undisplaced during rotation of the shaft when the sleeve member is permitted to rotate.

5. The apparatus of claim 1 wherein said tool guide unit comprises at least two parts which are detachably secured to one another and which are separable from one another on a plane that contains the axis of the drive shaft to provide for removal and replacement of said cam.

6. The apparatus of claim 5 wherein said sleeve portion has an axially slidable but nonrotatable connection with said drive shaft.

7. The apparatus of claim 6, further characterized in that:

(1) said tool guide unit has cam bearings secured therein, said cam bearings being at axially opposite sides of said cam, and (2) said sleeve portion projects axially to opposite sides of said cam and is received in both of said cam bearings to be confined to rotation by them.

* * * * *